US006597350B1

(12) United States Patent
Moriguchi et al.

(10) Patent No.: US 6,597,350 B1
(45) Date of Patent: Jul. 22, 2003

(54) IMAGE REPRODUCTION DEVICE AND METHOD OF IMAGE REPRODUCTION, TOGETHER WITH INFORMATION STORAGE MEDIUM

(75) Inventors: Akihiko Moriguchi, Yokohama (JP); Shigeru Sato, Tokyo (JP)

(73) Assignee: Namco Ltd., Tokyo (JP)

( * ) Notice: Subject to any disclaimer, the term of this patent is extended or adjusted under 35 U.S.C. 154(b) by 0 days.

(21) Appl. No.: 09/463,759

(22) PCT Filed: Jun. 4, 1999

(86) PCT No.: PCT/JP99/02987

§ 371 (c)(1),
(2), (4) Date: Mar. 15, 1999

(30) Foreign Application Priority Data

Jun. 4, 1998 (JP) ..... 10-172233

(51) Int. Cl.[7] ..... G09G 5/00
(52) U.S. Cl. ..... 345/204; 345/213
(58) Field of Search ..... 345/213, 204, 345/99, 98; 348/510, 540, 541, 525, 500, 537; 463/1, 43

(56) References Cited

U.S. PATENT DOCUMENTS 5,541,665 A * 7/1996 Urata et al. ..... 348/537
6,118,440 A * 9/2000 Tsunoda ..... 345/213
6,297,816 B1 * 10/2001 Nishitani et al. ..... 345/213

FOREIGN PATENT DOCUMENTS

| | | |
|---|---|---|
| JP | 7-334136 | 12/1995 |
| JP | 10-31467 | 2/1998 |
| JP | 10-39849 | 2/1998 |

* cited by examiner

*Primary Examiner*—Chanh Nguyen
(74) *Attorney, Agent, or Firm*—Oliff & Berridge, PLC

(57) ABSTRACT

The objective of the invention is to provide an image reproduction device that can take digital data that has been subjected to analog conversion and reproduce digital data therefrom that is substantially the same as the original digital data, without using over-sampling or special hardware.

An analog signal that was generated as a digital signal by an image generation device (200), but then subjected to analog conversion, and a synchronization signal from the image generation device (200) are input to an image reproduction device (100). A clock generation section (30) generates a sampling clock which has the same frequency as the dot clock used during the digital data generation, and with a suitably-adjusted phase, based on an input horizontal synchronization signal (12) together with frequency data (82) and phase data (84) as selected by a selection section (80). Digital data is reproduced from the input analog signal by an analog-digital converter (40), based on the thus generated sampling clock.

15 Claims, 8 Drawing Sheets

IMAGE REPRODUCTION DEVICE AND METHOD OF IMAGE REPRODUCTION, TOGETHER WITH INFORMATION STORAGE MEDIUM

TECHNICAL FIELD

This invention relates to an image reproduction device, an image reproduction method, and an information storage medium that enable the reproduction of digital dynamic image data from analog dynamic image data (a signal) that was generated as digital dynamic image data then was converted into an analog signal.

BACKGROUND OF ART

Ordinarily, digital dynamic image data that was generated as digital data by an image generation device such as a TV game machine is subjected to analog conversion to produce analog dynamic image data that can be displayed on a TV screen or CRT monitor or the like.

However, it is often convenient to work on image data, such as dynamic image data, as digital data when subjecting such image data to processing. Examples include superimposing captions on the image data or transmitting the image data over a network.

In such a case, it is necessary to subject that analog dynamic image data to analog-digital conversion such that it ends up as close to the original digital dynamic image data as possible, and reproduce it as digital dynamic image data.

During the reproduction of this digital dynamic image data that was fetched as analog dynamic image data, if the analog-digital conversion is done with no connection to the timing at which the original digital dynamic image data was generated, the phase and frequency of the sampling clock will differ from those of the sampling clock for the original digital dynamic image data and the thus-obtained digital dynamic image data could be vastly different from the original digital dynamic image data.

A method called over-sampling is used to ensure there is no such difference, but this doubles the amount of digital data that is handled, making it necessary to increase the operating frequency of the circuitry and thus making it necessary to use more precise and more expensive hardware.

There is another method of reproducing the digital dynamic image data by fetching it during the original digital dynamic image generation, before it is subjected to digital-analog conversion, but this necessitates special hardware and software, and is thus not practicable.

This invention was devised in the light of the above described technical problem and has as an objective thereof the provision of an image reproduction device, image reproduction method, and information storage medium that can take digital dynamic image data that has been subjected to analog conversion and reproduce digital dynamic image data therefrom that is substantially the same as the original digital dynamic image data.

DISCLOSURE OF THE INVENTION (1) According to a first aspect of the present invention, there is provided an image reproduction device for taking analog dynamic image data (a signal) obtained by performing an analog conversion of digital dynamic image data that was generated on the basis of a predetermined dot clock, and reproducing the digital dynamic image data therefrom, the image reproduction device comprising:

synchronization signal input means for inputting a synchronization signal for the digital dynamic image data;

clock generation means for generating a sampling clock which has the same frequency as that of the dot clock and which is also at a phase that is adjusted on the basis of the synchronization signal; and analog-digital conversion means for digitizing the analog dynamic image data, based on the sampling clock, to reproduce the digital dynamic image data.

According to a second aspect of the present invention, there is provided an image reproduction method for taking analog dynamic image data (a signal) obtained by performing an analog conversion of digital dynamic image data that was generated on the basis of a predetermined dot clock, and reproducing the digital dynamic image data therefrom, the image reproduction method comprising the steps of:

inputting a synchronization signal for the digital dynamic image data;

generating a sampling clock which has the same frequency as that of the dot clock and which is also at a phase that is adjusted on the basis of the synchronization signal; and reproducing the digital dynamic image data by digitizing the analog dynamic image data, based on the thus generated sampling clock.

According to a third aspect of the present invention, there is provided computer-usable information embodied on an information storage medium for implementing (executing) the above described means or steps. As an example of the information, there is a computer-usable program for implementing (executing) the above described means or steps. This program could be embodied in a carrier wave.

If the type of image generation device that generates and outputs the analog dynamic image data is known, the dot clock frequency for the digital dynamic image data that forms the source of the analog dynamic image data is identified thereby. If, for example, the image generation device is a game machine, the frequency of the dot clock used by that game machine can be identified from the type of the game machine.

Thus the image reproduction device of this invention receives the analog dynamic image data and also the synchronization signal that was used during the generation of the digital dynamic image data that is the source of this analog dynamic image data.

A sampling clock is then generated, based on a frequency corresponding to the dot clock for the pre-analog-conversion digital dynamic image data, which has been previously identified, and the input synchronization signal, so that this sampling clock has the same frequency as the dot clock and also has a phase that is adjusted to be suitable for sampling.

The thus-generated sampling clock is then used for sampling the input analog dynamic image data and thus reproduce the digital dynamic image data.

In this manner, during the regeneration of the digital dynamic image data from the input analog dynamic image data (signal), the digital data for each dot that configures this reproduced digital dynamic image data has substantially the same value as the digital data for each dot that configures the original digital dynamic image data as it was before the analog conversion. As a result, the image reproduction device can obtain digital dynamic image data that is faithful to the source image, without using the over-sampling method.

Note that RGB luminance signals or the like can be included in this analog dynamic image data, for example.

The synchronization signal used in this case could be both of the vertical synchronization signal and the horizontal synchronization signal, but the horizontal synchronization signal alone could be used, by way of example.

(2) According to a fourth aspect of the present invention, there is provided an image reproduction device for taking analog dynamic image data obtained by performing an analog conversion of digital dynamic image data that was generated by an image generation device, based on a predetermined dot clock, and reproducing the digital dynamic image data therefrom, the image reproduction device comprising:

synchronization signal input means for inputting a synchronization signal for the digital dynamic image data;

storage means for storing frequency data corresponding to the dot clock;

selection means for selecting frequency data for generating a sampling clock, from the frequency data stored in the storage means;

clock generation means for generating a clock at the same frequency as that of the dot clock, based on the selected frequency data, then generating the sampling clock from the clock, with a phase that is adjusted on the basis of the synchronization signal; and analog-digital conversion means for digitizing the analog dynamic image data, based on the thus generated sampling clock, to reproduce the digital dynamic image data.

According to a fifth aspect of the present invention, there is provided computer-usable information embodied on an information storage medium for implementing the above described means. As an example of the information, there is a computer-usable program for implementing the above described means. This program could be embodied in a carrier wave.

A sampling clock corresponding to a dot clock can be easily generated by previously storing frequency data corresponding to that dot clock, thus making it possible to improve the efficiency with which digital dynamic image data is reproduced.

In this aspect of the invention, a plurality of sets of frequency data corresponding to different devices is stored, to suit a plurality of image generation devices having different digital dynamic image data generation means. This makes it possible to easily generate a sampling clock corresponding to each type of device, even when digital dynamic image data is input from a plurality of image generation devices.

Note that the selection means could be configured in such a manner that the frequency data could be selected automatically or manually.

In addition, it is preferable that the frequency of the dot clock of each of these image generation devices is previously checked, and data is stored in a frequency data storage means of each device, based on the results of the check.

(3) The storage means may store phase data corresponding to the dot clock; the selection means may select phase data for generating a sampling clock, from the phase data stored in the storage means; and the clock generation means may generate a clock at the same frequency as that of the dot clock, based on the frequency data and the phase data, then generate the sampling clock from the clock, with a phase that is adjusted on the basis of the synchronization signal.

This makes it possible to generate any desired sampling clock to correspond to the dot clock, then adjust the phase of the sampling clock on the basis of the synchronization signal, by using a configuration whereby phase data is previously stored in addition to the frequency data.

The above described configuration also makes it possible to reduce special processing during the reproduction of the digital dynamic image data to only adjustment of the phase of the sampling clock, thus lightening the load on the CPU or the like and improving the efficiency with which digital dynamic image data is reproduced.

Note that phase data in this case is data for adjusting any discrepancy in phase between the generated sampling clock and the desired sampling clock, and any suitable data can be used therefor, such as data expressing a time difference of several nanoseconds.

In addition it is preferable that the frequency and phase of the dot clock of each of these image generation devices is previously checked, and data is stored in a storage means for frequency data and phase data of each device, based on the results of the check.

(4) The synchronization signal may be a horizontal synchronization signal; and the clock generation means may adjust the phase of the sampling clock, based on at least one of the rise and fall of the horizontal synchronization signal together with the phase data.

This makes it possible to generate a suitable sampling clock by adjusting the phase of the sampling clock when there are variations in the horizontal synchronization signal. It is therefore possible to reproduce the digital dynamic image data more faithfully from the original digital dynamic image data, by sampling with a sampling clock with a thus-adjusted phase.

(5) The analog-digital conversion means may convert the analog dynamic image data into digital dynamic image data at the timing of at least one of the rise and fall of the sampling clock.

For example, there is a stable portion where there is no variation in the analog dynamic image data (signal) at the rise of the sampling clock, so it is possible to reproduce digital dynamic image data that is faithful to the source image by subjecting the analog dynamic image data (signal) to analog-digital conversion at that timing.

(6) The image reproduction device of this invention may further comprise transmission means for transmitting the reproduced digital dynamic image data via a transmission path to a digital animation processing device.

The computer-usable information embodied on an information storage medium may further comprise information for implementing (executing) the above described means. As an example of the information, there is a computer-usable program for implementing (executing) the above described means. This program could be embodied in a carrier wave.

In this way, the digital animation processing device that is the transmission goal can process digital dynamic image data that is faithful to the original digital dynamic image data.

In this case, transmission path is not limited to a wired communications line such as a cable; it could also include wireless means such as satellite communications. In addition, transmission is not just to an external device by cable; it could also be over a system bus within a device, for example.

If, for example, digital dynamic image data is transmitted over a cable from the image reproduction device to the other processing device, the image reproduction device can transmit digital dynamic image data that is faithful to the original digital dynamic image data.

This makes it possible for the other processing device to process data that is substantially the same as the original data.

(7) The digital animation processing device may be a digital animation display device.

A general-purpose image generation device is assumed to output to a TV or CRT monitor, so it outputs an analog dynamic image signal.

Since it is not assumed that this analog signal will be re-digitized, it does not comprise a dot clock signal.

However, in a digital animation display device that uses liquid crystal or the like for a liquid crystal means, the input analog dynamic image signal is re-digitized for display. During this digitization, signal disturbances can easily occur.

It is therefore necessary to provide adjustment (correction) means for manual operation on the digital animation display device side, to manually correct such disturbances in the signal.

This invention makes it possible to reproduce digital dynamic image data from analog dynamic image data, so that a digital animation display device can display a clear image that is faithful to the source image, without necessitating such correction.

(8) The digital dynamic image data may be dynamic image data for a game.

In this case, the image generation device that generates digital dynamic image data is limited to a game machine. This makes it easy to distinguish between different image generation devices. As a result, players can obtain good image quality, even when different game machines are connected for monitor output.

(9) This invention can also be applied to the processing of static image data, in addition to dynamic image data.

BEST MODE FOR CARRYING OUT THE INVENTION

Embodiments of this invention wherein this invention is applied to game systems are described below with reference to the accompanying drawings.

First Embodiment

Figure 1:
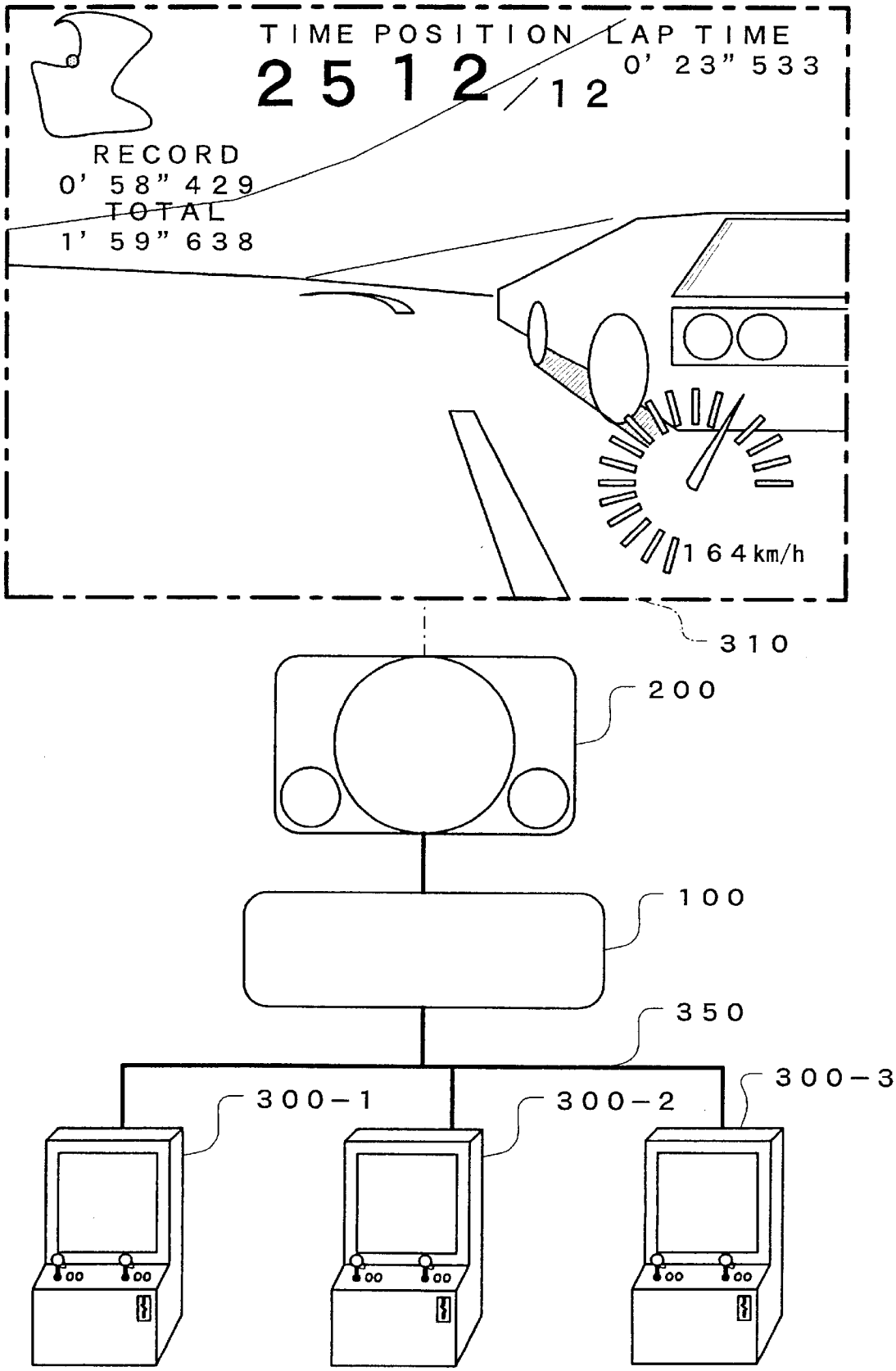
FIG. 1 shows an example of a game system that uses an image reproduction device in accordance with an embodiment of this invention.

An example of a game system in accordance with this invention is shown in FIG. 1.

The system of this embodiment comprises an image generation device 200 that is a TV game machine that computes game image data for providing a game to be displayed on a TV set, an image reproduction device 100 that is one embodiment of this invention, and a plurality of game terminals 300-1, 300-2, and 300-3 connected to the image reproduction device 100 by cables 350.

The image generation device 200, such as this TV game machine, computes and generates game screens as digital dynamic image data. However, in order to make this image data displayable on a domestic TV set 310, it converts a digital signal of the generated digital dynamic image data temporarily into an analog dynamic image signal (an RGB luminance signal), then supplies it to the TV set 310.

The TV set 310 displays game screens on its screen, based on the thus-supplied analog dynamic image signal.

In this manner, the image generation device 200 such as a TV game machine computes and generates dynamic image data as digital dynamic image data, converts it into an analog dynamic image signal that is suitable for the TV set 310, then outputs it.

However, if data processing is to be performed on this dynamic image data, it is often more convenient to use the dynamic image data as digital data. It may be required to write captions over the image data or transmit the image data to digital data processing device (in this embodiment, the game terminals 300-1, 300-2, and 300-3) over the cables 350, for instance.

More specifically, it is possible that the analog dynamic image signal that is output from the image generation device 200 might be supplied to the plurality of game terminals 300-1 300-2, and 300-3 that are digital data processing device through the cables 350, as shown in FIG. 1.

In the system of this embodiment, the image reproduction device 100 is provided at the output stage of the image generation device 200, the analog dynamic image signal that is output from the image generation device 200 is once again converted into digital dynamic image data, and the reconverted digital dynamic image data is supplied to the game terminals 300-1, 300-2, and 300-3 through the cables 350.

The description now turns to details of the image reproduction device 100 of this embodiment of the invention.

The image reproduction device 100 takes the analog dynamic image signal that is input thereto and reproduces digital dynamic image data that is as similar as possible to the original digital dynamic image data that was computed and generated by the image generation device 200, as previously described.

Thus the image reproduction device 100 subjects the input analog dynamic image signal to analog-digital conversion, and outputs digital dynamic image data.

To ensure that this image reproduction device 100 faithfully reproduces the pre-analog-conversion digital dynamic image data from the input analog dynamic image signal, it is important to set the frequency and phase of the sampling clock that is used for converting the analog dynamic image signal into the digital dynamic image data.

Digital dynamic image data 402 from the image generation device 200, a dot clock 400 that is used during the computation and generation of this digital dynamic image data 402, an analog dynamic image signal 404 that is obtained by converting this digital dynamic image data 402 to analog data, digital dynamic image data 412 and 422 converted from this analog dynamic image signal in accordance with a predetermined sampling clock on the fetch side of the analog dynamic image signal 404, and analog dynamic image signals 414 and 424 converted from the digital dynamic image data 412 and 422 are shown in FIGS. 2 and 3.

Figure 2A:
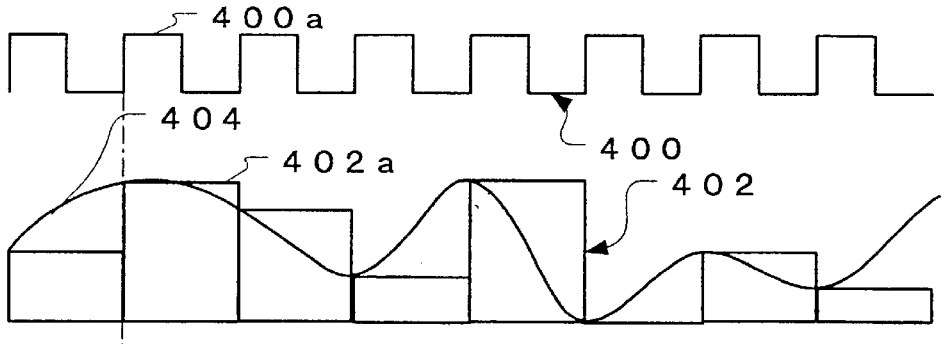
FIG. 2A shows a digital dynamic image data, dot clock and analog dynamic image signal generated by an image generation device.

FIG. 2A shows an example of the digital dynamic image data 402 generated by the image generation device 200 and the dot clock 400 therefor, together with an example of the analog dynamic image signal 404 obtained by converting the digital dynamic image data 402 to analog data.

As shown in FIG. 2A, the image generation device 200 generates the digital dynamic image data 402 in synchronization with the dot clock 400. In other words, the digital dynamic image data 402 that is generated has pixel data 402a for each pulse 400a of the dot clock 400.

The image generation device 200 of this embodiment is configured to output a synchronization signal (not shown in this figure) through a predetermined output port.

The image generation device 200 outputs the digital dynamic image data 402 as the converted analog dynamic image signal 404, so that it can be reproduced by the TV set 310.

It is important to set the frequency and phase of the sampling clock in order to faithfully reproduce the pre-analog-conversion digital dynamic image data 402 from the analog dynamic image signal 404 that is output from the image generation device 200.

Figure 2B:
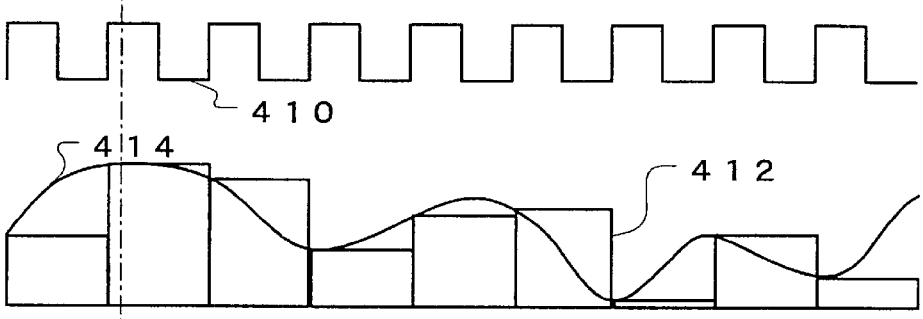
FIG. 2B shows an analog dynamic image signal and digital dynamic image data obtained by subjecting the analog dynamic image signal to analog-digital conversion, using a sampling clock having a frequency shift between the side that fetched the analog dynamic image signal and the side that generated the dynamic image signal.

For example, the digital dynamic image data 412 that is obtained by subjecting the input analog dynamic image signal 404 to analog-digital conversion using a sampling clock 410 of a frequency that differs from the frequency of the dot clock 400, as shown in FIG. 2B, cannot be said to faithfully reproduce the digital dynamic image data 402 produced during the image generation, shown in FIG. 2A.

Figure 2C:
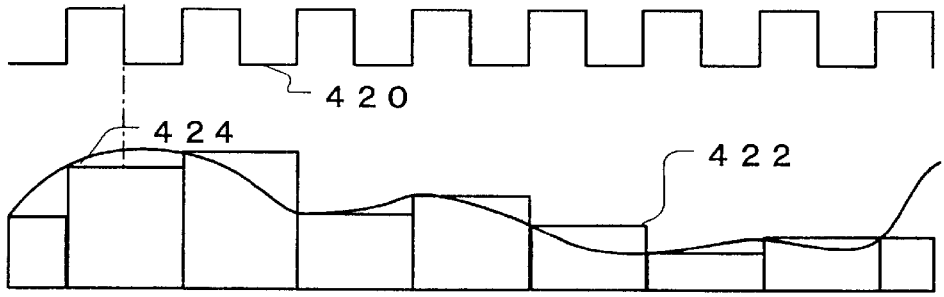
FIG. 2C shows an analog dynamic image signal and digital dynamic image data obtained by subjecting the analog dynamic image signal to analog-digital conversion, using a sampling clock with an unsuitable phase.

Similarly, the digital dynamic image data 422 that is obtained by subjecting the input analog dynamic image signal 404 to analog-digital conversion using a sampling clock 420 that has the same frequency as the dot clock 400 but is not at a phase that is appropriate for sampling, as shown in FIG. 2C, will not be the same as the digital dynamic image data 402 produced during the image generation.

If, therefore, this digital dynamic image data 412 or 422 is subjected to digital-analog conversion to reproduce an analog dynamic image signal, the reproduced analog dynamic image signal 414 or 424 will differ widely from the original analog dynamic image signal 404, as shown in FIGS. 2B and 2C.

Figure 3A:
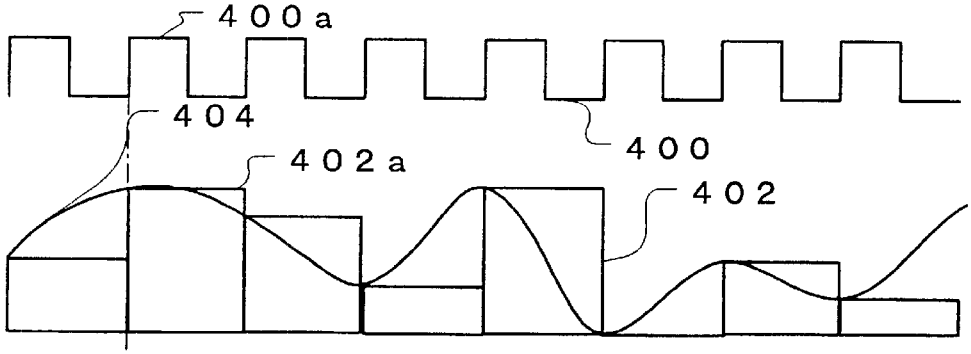
FIG. 3A shows an analog dynamic image signal and digital dynamic image data of a dynamic image that was generated by an image generation device.
Figure 3B:
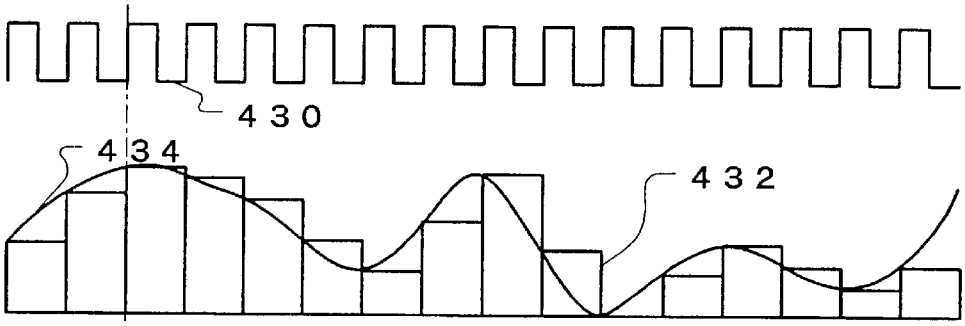
FIG. 3B show an analog dynamic image signal and digital dynamic image data obtained by subjecting the analog dynamic image signal to analog-digital conversion, using a sampling clock with the over-sampling method on the side that fetched the analog dynamic image signal.
Figure 3C:
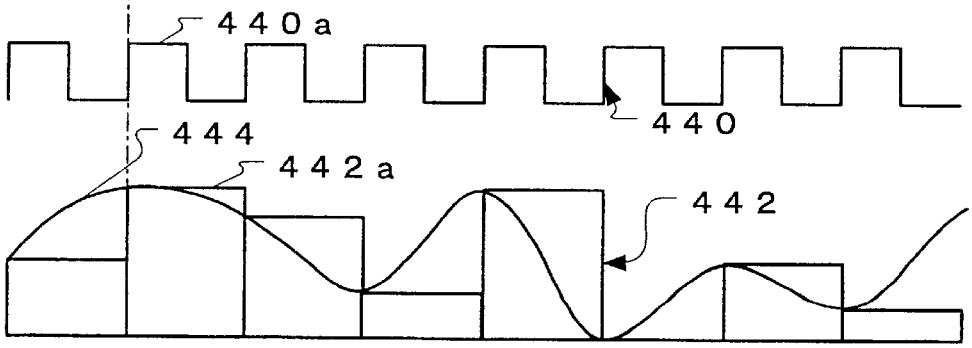
FIG. 3C shows an analog dynamic image signal and digital dynamic image data obtained by subjecting the analog dynamic image signal to analog-digital conversion, using a sampling clock in accordance with the method of this invention.

FIGS. 3A to 3C show the prior-art over-sampling method that is utilized to solve this technical problem, together with an example of a method wherein this embodiment of the invention is applied. Note that the data of FIG. 3A is the same as that shown in the previously described FIG. 2A, so the items therein are denoted by the same reference numbers and further description thereof is omitted.

FIG. 3B shows digital dynamic image data 432 obtained by digitizing the analog dynamic image signal 404 (the output of the image generation device 200) by the over-sampling method, using a sampling clock 430 on the fetch side of the analog dynamic image signal 404, and an analog dynamic image signal 434 obtained by re-converting this digital dynamic image data 432 into an analog signal.

As shown in this figure, when the over-sampling method is used, the analog dynamic image signal 434 after the reconversion is very similar to the original analog dynamic image signal 404. However, as is well-known in the over-sampling field, the amount of data that is subjected to this computation is doubled, and thus the amount of memory required is also doubled. Moreover, it is necessary to provide fast and expensive hardware.

There is another method whereby the digital dynamic image data 402 is fetched before it is subjected to the digital-analog conversion, during the generation of the original digital dynamic image data 402, but it requires special hardware and software and is thus not practicable.

FIG. 3C shows a sampling clock 440 for the analog dynamic image signal 404 that was generated by using the method of this invention, digital dynamic image data 442 reproduced by digitizing the analog dynamic image signal 404 using this sampling clock 440, and an analog dynamic image signal 444 obtained by subjecting this digital dynamic image data 442 to analog conversion.

If the type of the image generation device 200 is specified, that identifies the frequency of the dot clock 400 used in the generation of the digital dynamic image data 402 by the image generation device 200. For example, if the TV game machine that is the image generation device 200 is specified as being from one of Company A, Company B, and Company C, the frequency of the dot clock 400 is also specified in accordance with the manufacturer of that TV game machine.

Even if the image generation device 200 is not a TV game machine, the dot clock frequency used therefor can be specified provided that the type of that device is specified.

In particular, there is often a limited number of manufacturers of game machines such as TV game machines, so that dot clock frequencies used therein are also limited. In addition, the dot clock frequencies used in such game machines are often identified beforehand.

This embodiment of the invention is designed around this characteristic of the image generation device 200. The image reproduction device 100 generates the sampling clock 440 having the clock pulses 440*a*that are of the same frequency as the clock pulses 400*a*of the dot clock 400 used by the image generation device 200 and are also set to a suitable phase, based on the frequency of the dot clock 400 and a synchronization signal for the digital dynamic image data 402 that is output from an output port of the image generation device 200, as shown in FIG. 3C. The image reproduction device 100 then uses the thus-generated sampling clock 440 to subject the analog dynamic image signal 404 to analog-digital conversion.

The digital dynamic image data 442 that is obtained by this analog-digital conversion has pixel data 442*a*that is substantially the same as the pixel data 402*a*of the original digital dynamic image data 402 shown in FIG. 3A.

This ensures that the image reproduction device 100 of this embodiment of the invention can faithfully reproduce the pre-analog-conversion digital dynamic image data 402 from the analog dynamic image signal 404 that is output from the image generation device 200, and thus obtain the digital dynamic image data 442.

The description now turns to details of the image reproduction device 100.

Note that the method of generating the sampling clock 440 will be described later.

Figure 4:
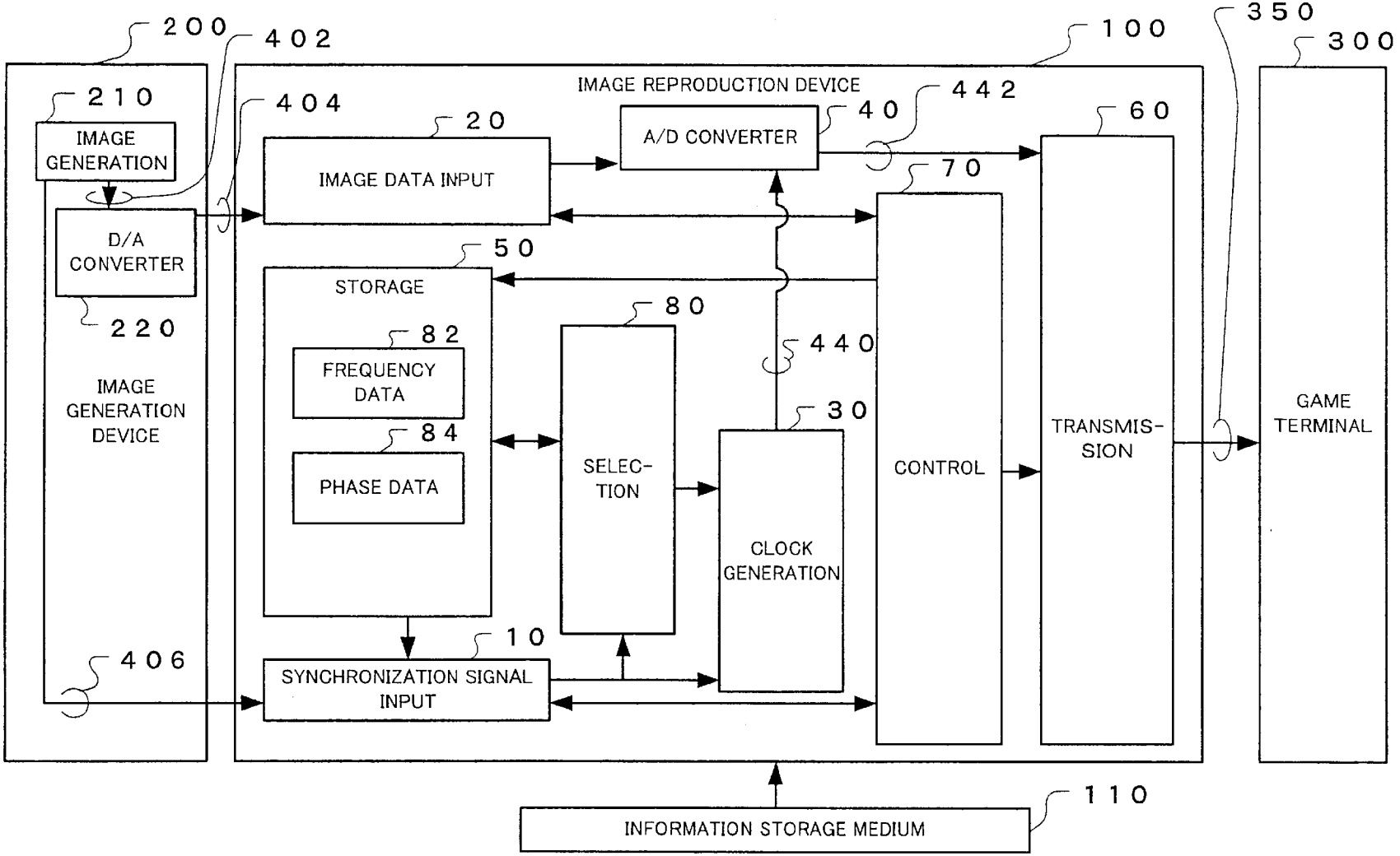
FIG. 4 is a functional block diagram of a digital reproduction device in accordance with an example of this embodiment of the invention.

A functional block diagram of the image generation device 200 and the image reproduction device 100 of an example of this embodiment of the invention is shown in FIG. 4.

The image generation device 200 of this embodiment comprises a image generation section 210 that computes and generates the digital dynamic image data 402, based on a predetermined game program and inputs from a manipulation section (not shown in the figure), and a digital-analog converter 220 that converts the digital dynamic image data 402 into the analog dynamic image signal 404. The analog dynamic image signal 404 is output to the image reproduction device 100.

In addition, the image generation device 200 outputs a synchronization signal 406 that is used during the generation of the digital dynamic image data 402, through a predetermined output port to the image reproduction device 100.

The image reproduction device 100 comprises a control section 70 that controls the entire device, an image data input section 20, a synchronization signal input section 10, and an analog-digital converter 40 that reproduces the digital dynamic image data 442 from the analog dynamic image signal 404.

The image reproduction device 100 of this embodiment of the invention also comprises a storage section 50, a selection section 80, and a clock generation section 30, to enable the analog-digital converter 40 to generate a sampling clock for converting the analog signal to a digital signal.

The analog dynamic image signal 404 that is input to the image reproduction device 100 is supplied to the analog-digital converter 40 through the image data input section 20.

At the same time, the synchronization signal 406 that is input to the image reproduction device 100 is supplied to the clock generation section 30 through the synchronization signal input section 10.

Both a horizontal synchronization signal and a vertical synchronization signal are input as the synchronization signal 406, but in this embodiment of the invention only the horizontal synchronization signal is used for clock generation.

Data such as frequency data 82 and phase data 84 for the different types of dot clock 400 of a plurality of image generation devices 200, which have been previously determined to be used, is previously stored in the storage section 50. In other words, the frequency data 82 and the phase data 84 is stored for each type of image generation device that has been determined to be used.

In this case, the frequency data 82 could be numeric data such as several megahertz and the phase data 84 could be numeric data such as a phase of several nanoseconds.

Other data that is usually used for the reproduction of an image can also be stored in the storage section 50 in addition to this data, such as gain and bias.

The selection section 80 selects from the data in the storage section 50 the frequency data 82 and the phase data 84 for the dot clock 400 that corresponds to the image generation device 200, based on the synchronization signal 406 that is input from the image generation device 200 or manual actions from a manipulation section (not shown in the figure).

Specifically, this embodiment of the invention is configured in such a manner that the frequency data 82 and the phase data 84 corresponding to the image generation device 200 can be selected by a manual operation, such as pressing a button. Note that it is also possible to have a configuration in which a signal is input from the image generation device 200, indicating the type thereof, and the data is selected automatically.

The frequency data 82 and the phase data 84 selected by the selection section 80 is supplied to the clock generation section 30.

The clock generation section 30 bases the predetermined clock on the selected frequency data 82 and phase data 84. The phase of this clock is adjusted to a phase that is suitable for sampling, based on the synchronization signal 406 supplied from the image generation device 200. This ensures that the sampling clock 440 that is generated has the same frequency as that of the dot clock 400 used during the generation of the digital dynamic image data 402, and is also at a phase that is appropriate for sampling. The generation of the sampling clock 440 will be described later.

The generated sampling clock 440 is supplied to the analog-digital converter 40.

The analog-digital converter 40 subjects the analog dynamic image signal 404 to analog-digital conversion, based on the sampling clock 440, to generate the digital dynamic image data 442. This digital dynamic image data 442 is transmitted to a digital data processing device 300 through a transmission section 60.

Note that hardware that can implement the image reproduction device 100 is as described below. The synchronization signal input section 10, the image data input section 20, and the transmission section 60 can be implemented by input-output ports; the control section 70 and the selection section 80 by a CPU; the storage section 50 by ROM or RAMS; the analog-digital converter 40 by an A/D converter; and the clock generation section 30 by a phase-locked loop (PLL) circuit, for example.

The system of this embodiment also comprises an information storage medium 110. The information storage medium (a storage medium that makes it possible for information to be read therefrom by a computer) 110 contains information such as a program and data, where the functions thereof can be implemented by hardware such as an optical disk, a magneto-optical disk, a magnetic disk, a hard disk, magnetic tape, or semiconductor memory (ROM). Based on the information stored in this information storage medium 110, the image reproduction device 100 performs processing in accordance with this invention (this embodiment); in other words, it performs the functions of components such as the image data input section 20, the synchronization signal input section 101 the analog-digital converter 401 the storage section 50, the clock generation section 30, the selection section 80, the control section 70, and the transmission section 60.

In other words, the information storage medium 110 contains various types of information (programs and data) for implementing the various means of this invention (this embodiment).

Note that all or part of the information stored in the information storage medium 110 is transferred to the storage section 50 of the image reproduction device 100 and another storage section, such as when the system is turned on, so that the image reproduction device 100 can function as the above described means of the invention. The information stored in the information storage medium 110 comprises at least one of: information for performing the processing in accordance with this invention, information for instructing the processing in accordance with this invention, and information for performing processing in accordance with such instructions.

Figure 5:
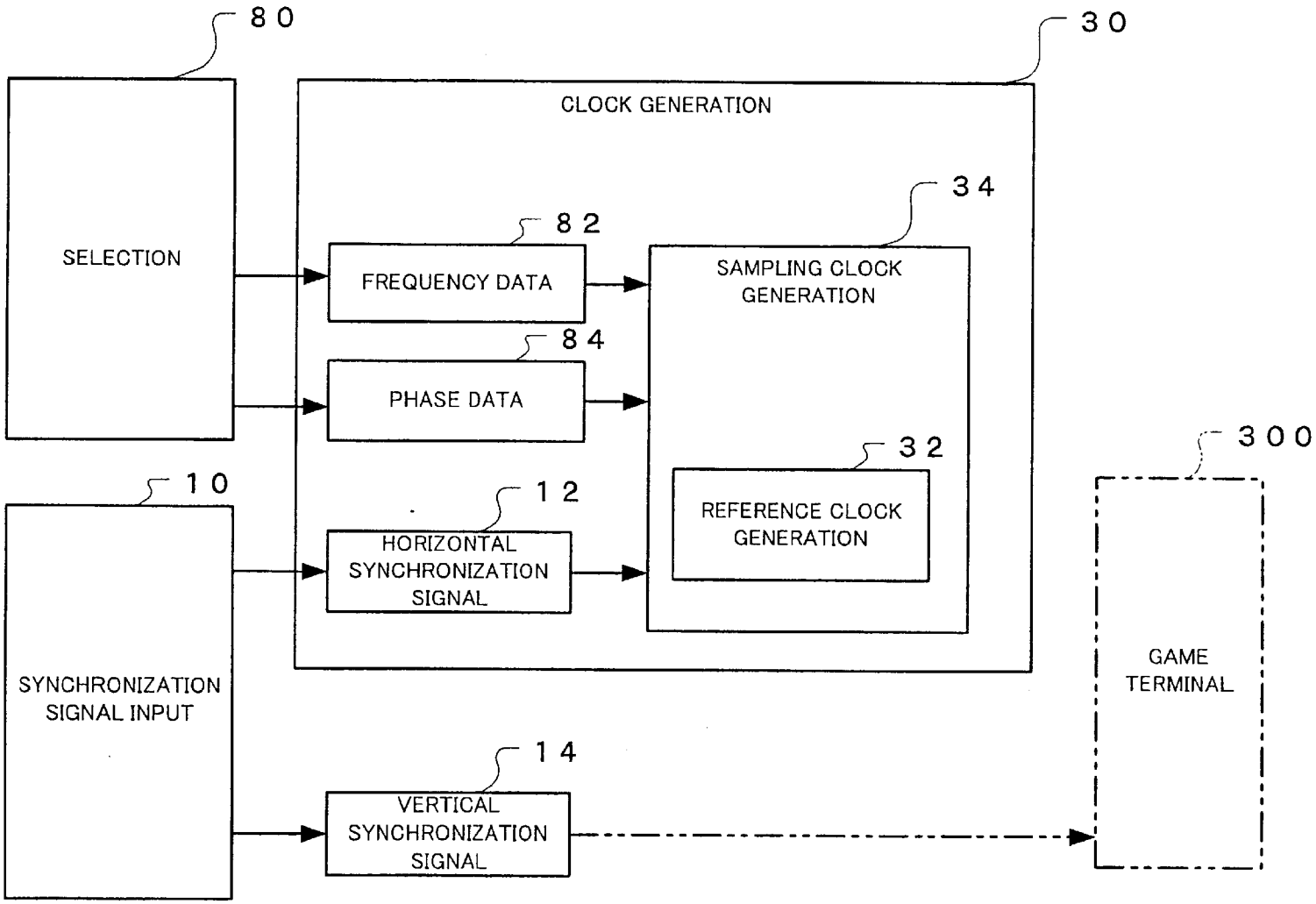
FIG. 5 is a functional block diagram of a clock generation section in accordance with an example of this embodiment of the invention.
Figure 6:
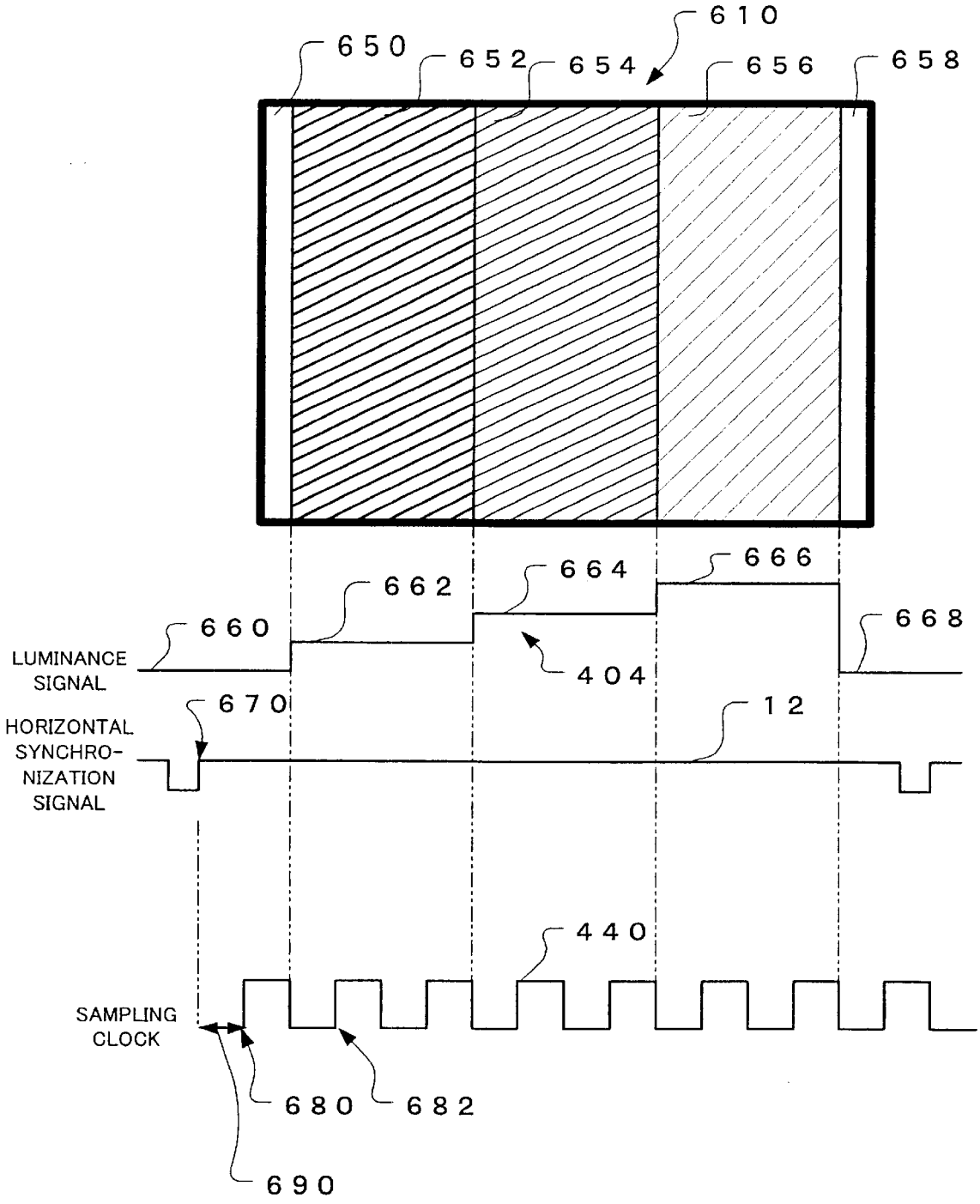
FIG. 6 is illustrative of a method of setting a sampling clock in accordance with an example of this embodiment of the invention.

A functional block diagram of the clock generation section 30 in accordance with an example of this embodiment of the invention is shown in FIG. 5. The method of generating the sampling clock 440 is illustrated in FIG. 6.

The description below concerns the generation of the sampling clock 440 by the clock generation section 30.

As shown in FIG. 5, the clock generation section 30 comprises a sampling clock generation section 34. The sampling clock generation section 34 comprises a reference clock generation section 32 that generates a reference clock which is used as an initial value.

A horizontal synchronization signal 12 from the synchronization signal input section 10 is input to the clock generation section 30. Note that the vertical synchronization signal 14 that is input to the synchronization signal input section 10 is sent to each game terminal 300 where it is used for image display.

The sampling clock generation section 34 gradually changes the reference clock as an initial value, based on the input frequency data 82, to adjust the frequency until it is the same as the frequency of the dot clock 400 of the image generation device 200. The clock with the thus-adjusted frequency then has the phase thereof adjusted to form a sampling clock suitable for sampling, based on the phase data 84 and the horizontal synchronization signal 12, to create the sampling clock 440.

Assume, for example, that a certain screen 610 as shown in FIG. 6 is made up of a black portion 650 along the left edge of the screen, a dark portion 652, an intermediate brightish portion 654, a bright portion 656, and a black portion 658 along the right edge of the screen.

A luminance signal that is the analog dynamic image signal 404 has various signal levels 660 to 668, corresponding to these portions 650 to 658 of the screen 610.

The sampling clock generation section 34 first generates a clock of a predetermined frequency, based on the frequency data 82, in order to generate the sampling clock 440. As shown in FIG. 6, the phase of the clock is adjusted so that the rise 680 of the thus-generated clock has a phase difference 690, as indicated by the phase data 84, with reference to the rise 670 or fall of the horizontal synchronization signal 12, and thus the sampling clock 440 is generated. Note that FIG. 6 shows the use of the rise 670 of the horizontal synchronization signal 12, but the fall of the horizontal synchronization signal 12 could equally well be used.

The horizontal synchronization signal 12 that is input to the sampling clock generation section 34 is a signal used to generate the digital dynamic image data 402 in the image generation device 200, and it is also synchronized with the luminance signal.

Thus falls in the sampling clock 440 match changes in the luminance signal, as shown in FIG. 6. Conversely, rises in the sampling clock 440 are at stable points at which there is no change in the luminance signal.

For example, a rise 682 in the sampling clock 440 is at a stable portion at which there is no change in the signal level 662 of the luminance signal, making it possible to faithfully reproduce the digital dynamic image data by performing the analog-digital conversion of the luminance signal at that timing.

In this manner, it is possible to faithfully reproduce the original digital dynamic image data 402 by digitizing the luminance signal, which is the analog dynamic image signal 404, at the rise 682 of the sampling clock 440.

The sampling clock 440 that is generated in the above manner has the same frequency as the dot clock 400 used during the generation of the original digital dynamic image data 402 and the phase thereof is set to the optimal phase for sampling. It is therefore possible to faithfully recreate the original digital dynamic image data 402 by basing the digitization of the input analog dynamic image signal 404 on this sampling clock 440, as shown in FIG. 3C. In addition, the following effects can be achieved First of all, the image reproduction device 100 can display on each game terminal 300 an optimal image that is the same as that obtained at the generation of the dynamic image, even when the reproduced digital dynamic image data 442 has been transmitted to a game terminal 300 in a distant location through the cable 350.

In addition, employment of the sampling clock 440 ensures that the image reproduction device 100 does not need to use special hardware or over-sampling. This makes it possible to simplifies the hardware of the image reproduction device 100.

The image reproduction device 100 could be integrated with the game terminal 300. This would make it possible to implement a game terminal 300 that can display the original image cleanly.

If the image generation device 200 connected to the image reproduction device 100 is limited to a single type, the image reproduction device 100 could have a configuration such that the frequency of the sampling clock is generated without using the frequency data 82 and phase data 84 for the dot clock 400, and the phase of the sampling clock is set by using the horizontal synchronization signal 12. This makes it possible to reduce the storage area of the image reproduction device 100, in comparison with the configuration in which the frequency data 82 and the phase data 84 is used, so that phase adjustment will suffice for clock correction.

Similarly, the configuration could be such that the frequency data 82 alone is stored and the setting of the phase of the sampling clock is based on the horizontal synchronization signal 12.

Second Embodiment

Figure 8:
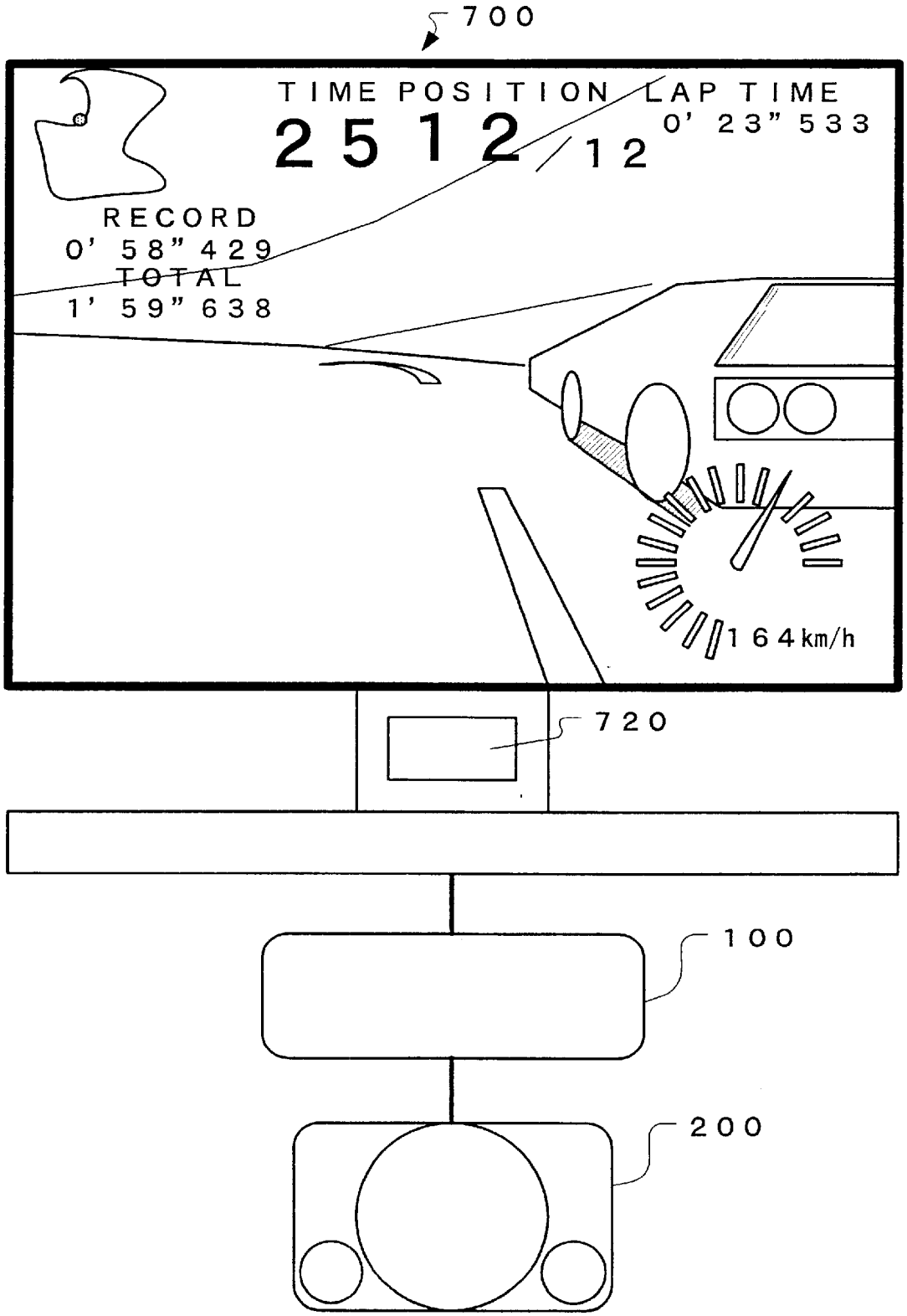
FIG. 8 is illustrative of a method of use of an image reproduction device in accordance with another embodiment of this invention.

An illustrative view of a method of using the image reproduction device 100 in accordance with another embodiment of this invention is shown in FIG. 8.

The first embodiment of this invention related to an example in which the digital dynamic image data 442 reproduced by the image reproduction device 100 is transmitted to another digital animation processing device (a game terminal). This embodiment of the invention is described with reference to the use of a digital animation display device, particularly a liquid crystal display device 700, as a digital data processing device.

The liquid crystal display device 700 can only drive the liquid crystal panel thereof in a digital fashion. It is therefore necessary to use an adjustment section 720 or the like to adjust the display manually, unlike with an ordinary CRT monitor.

In other words, the analogue dynamic image data 404 for CRT. monitor output is subjected to analog-digital conversion on the liquid crystal display device 700 side. However, this analogue dynamic image data 404 does not allow for re-digitization. For that reason, this analogue dynamic image data 404 does not comprise a dot clock signal, and thus the dynamic image signal digitized on the liquid crystal display device 700 side is readily subject to signal disturbances, such as reflections.

With a liquid crystal device, any disturbance in the signal can easily be magnified during digitization. In addition, if there is any disturbance in the signal, differences between video cards and other video equipment make it necessary to adjust the signal to accommodate such disturbances.

When images are displayed with different types of image generation device 200 connected to the liquid crystal display device 700, in particular, the work of adjusting on the liquid crystal display device 700 side is a great problem.

If method in accordance with the first embodiment of this invention is applied to this problem, the user can faithfully reproduce the source image from the digital dynamic image data 442 by using the image reproduction device 100, without any troublesome manual adjustment.

Hardware Configuration

Figure 7:
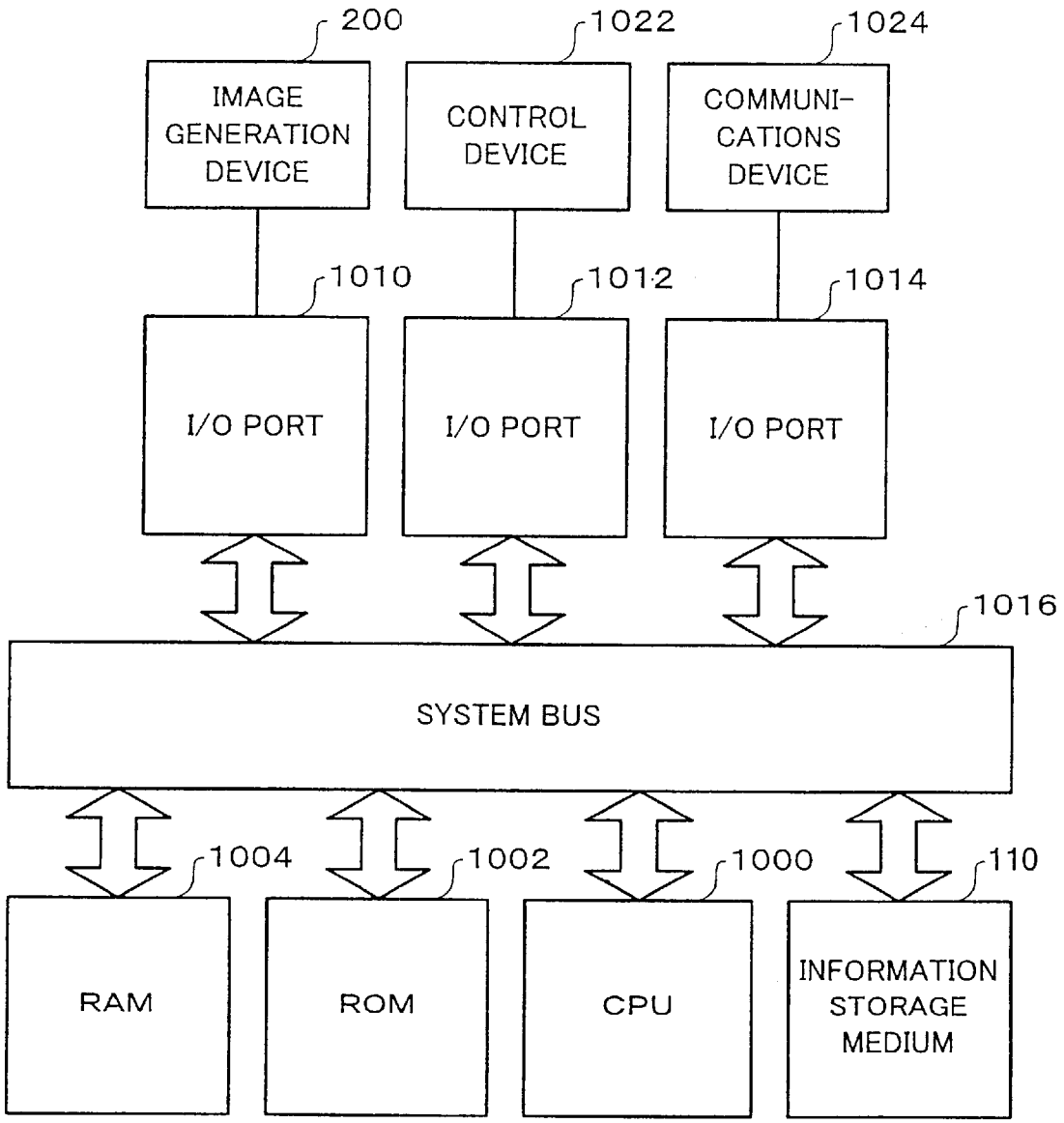
FIG. 7 shows an example of a hardware configuration that can implement this embodiment of the invention.

The description now turns to an example of hardware that can implement the image reproduction device 100 of the above described embodiment of invention, with reference to FIG. 7. In the system shown in this figure, a CPU 1000, ROM 1002, RAM 1004, the information storage medium 110, and I/O ports 1010, 1012, and 1014 are connected together by a system bus 1016 in such a manner that data can be mutually transferred therebetween.

The image generation device 200 is connected to the I/O port 1010, a control device 1022 is connected to the I/O port 1012, and a communications device 1024 is connected to the I/O port 1014.

The information storage medium 110 is mainly used for storing data or the like. Means such as a DVD, game cassette, or CD-ROM could be used as an information storage medium for storing a program and other data, by way of example.

The control device 1022 is equivalent to an operating panel, or the like.

The CPU 1000 controls the entire system and processes data in accordance with a program stored in the information storage medium 110, a system program stored in the ROM 1002 (including initialization information for the entire system), and signals input through the control device 1022. The RAM 1004 is a storage means that is used as a work space for the CPU 1000, and specific details from the information storage medium 110 or the ROM 1002, or the results of calculations by the CPU 1000, are stored therein. A data configuration having a logical structure suitable for implementing this embodiment of the invention is constructed within this RAM 1004 or information storage medium 110.

The communications device 1024 transfers various types of information used within the game system to and from external devices, and it is used to send or receive given information in accordance with a game program when connected to another game system, or to send or receive information such as a game program over a communications line.

The processing described with reference to FIGS. 1 to 6 and 8 is implemented by components such as the information storage medium 110 that contains a program and data, as well as the CPU 1000 that operates in accordance with information from the information storage medium 110.

Note that this invention is not limited to the above described game systems, and thus it can be applied to a general-purpose network system or the like in which an analog dynamic image signal, which has been generated as a digital signal, is output to a digital output apparatus.

In addition, this invention is particularly applicable to an analog dynamic image signal that is digital dynamic image data that has been subjected to analog conversion, but it can also be applied to any analog data obtained by analog conversion of digital data, such as static images or numerical data. This makes it possible to reproduce digital data that is faithful to the original digital data.

In this case, the above described transmission path is not limited to a wired communications line such as a cable; it could also include wireless means such as satellite communications. In addition, transmission is not just to an external device by cable; it could also be over a system bus within a device, for example.

Furthermore the digital processing device is designed for processing any desired digital animation from digital dynamic image data that is input thereto, so, in addition to the above described devices, this device could be a digital video printer, a dedicated digital animation computer, or another computer linked by a network, by way of example.

This invention can also be used during development or debugging. In other words, the application of this invention makes it possible to determine whether a generated analog dynamic image signal copies the original digital dynamic image data accurately.

What is claimed is:

1. An image reproduction device for taking analog dynamic image data obtained by performing an analog conversion of digital dynamic image data that was generated by an image generation device, based on a predetermined dot clock, and reproducing said digital dynamic image data from said analog dynamic image data, said image reproduction device comprising:

synchronization signal input means for inputting a synchronization signal for said digital dynamic image data;

storage means for storing frequency data corresponding to said dot clock;

selection means for selecting frequency data for generating a sampling clock, from said frequency data stored in said storage means;

clock generation means for generating a clock at the same frequency as the frequency of said dot clock, based on said selected frequency data, then generating said sampling clock from said clock, with a phase that is adjusted on the basis of said synchronization signal; and analog-digital conversion means for digitizing said analog dynamic image data, based on the thus generated sampling clock, to reproduce said digital dynamic image data.

2. The image reproduction device as defined in claim 1, wherein said storage means stores phase data corresponding to said dot clock;

wherein said selection means selects phase data for generating a sampling clock, from said phase data stored in said storage means; and wherein said clock generation means generates a clock at the same frequency as the frequency of said dot clock, based on said frequency data and said phase data, then generates said sampling clock from said clock, with a phase that is adjusted on the basis of said synchronization signal.

3. The image reproduction device as defined in claimed 2, wherein said synchronization signal is a horizontal synchronization signal; and wherein said clock generation means adjusts the phase of said sampling clock, based on at least one of the rise and fall of said horizontal synchronization signal together with said phase data.

4. The image reproduction device as defined in claim 3, wherein said analog-digital conversion means converts said analog dynamic image data into digital dynamic image data at the timing of at least one of the rise and fall of said sampling clock.

5. The image reproduction device as defined in claim 1, further comprising:

transmission means for transmitting said reproduced digital dynamic image data via a transmission path to a digital animation processing device.

6. The image reproduction device as defined in claim 5, wherein said digital animation processing device is a digital animation display device.

7. The image reproduction device as defined in claim 1, wherein said digital dynamic image data is dynamic image data for a game.

8. An image reproduction method for taking analog dynamic image data obtained by performing an analog conversion of digital dynamic image data that was generated on a basis of a predetermined dot clock, and reproducing said digital dynamic image data from said analog dynamic image data, said image reproduction method comprising the steps of:

inputting a synchronization signal for said digital dynamic image data;

selecting frequency data stored in a memory corresponding to said dot clock for generating a sampling clock;

generating a clock which has a same frequency as the frequency of said dot clock on a basis of said frequency data, then generating a sampling clock from said clock, which is at a phase that is adjusted on a basis of said synchronization signal; and reproducing said digital dynamic image data by digitizing said analog dynamic image data, based on the thus generated sampling clock.

9. Computer-usable information embodied on an information storage medium or in a carrier wave for taking analog dynamic image data obtained by performing an analog conversion of digital dynamic image data that was generated on the basis of a predetermined dot clock, and reproducing said digital dynamic image data from said analog dynamic image data, said computer-usable information further comprising information for implementing:

synchronization signal input means for inputting a synchronization signal for said digital dynamic image data;

storage means for storing frequency data corresponding to said dot clock;

selection means for selecting frequency data for generating a sampling clock, from a plurality of sets of said stored frequency data, under a predetermined condition;

clock generation means for generating a clock at the same frequency as the frequency of said dot clock, based on said selected frequency data, then generating said sampling clock from said clock, with a phase that is adjusted on the basis of said synchronization signal; and analog-digital conversion means for digitizing said analog dynamic image data, based on the thus generated sampling clock, to reproduce said digital dynamic image data.

10. The computer-usable information embodied on an information storage medium or in a carrier wave as defined in claim 9, wherein said storage means stores phase data corresponding to said dot clock;

wherein said selection means selects phase data for generating a sampling clock, from said stored phase data; and wherein said clock generation means generates a clock at the same frequency as the frequency of said dot clock, based on said frequency data and said phase data, then generates said sampling clock from said clock, with a phase that is adjusted on the basis of said synchronization signal.

11. The computer-usable information embodied on an information storage medium or in a carrier wave as defined in claim 10, wherein said synchronization signal is a horizontal synchronization signal; and wherein said clock generation means adjusts the phase of said sampling clock, based on at least one of the rise and fall of said horizontal synchronization signal together with said phase data.

12. The computer-usable information embodied on an information storage medium or in a carrier wave as defined in claim 11, wherein said analog-digital conversion means converts said analog dynamic image data into digital dynamic image data at the timing of at least one of the rise and fall of said sampling clock.

13. The computer-usable information embodied on an information storage medium or in a carrier wave as defined in claim 9, further comprising information for implementing, transmission means for transmitting said reproduced digital dynamic image data through a transmission path to a digital animation processing device.

14. The computer-usable information embodied on an information storage medium or in a carrier wave as defined in claim 13, wherein said digital animation processing device is a digital animation display device.

15. The computer-usable information embodied on an information storage medium or in a carrier wave as defined in claim 10, wherein said digital dynamic image data is dynamic image data for a game.

* * * * *